US005449415A

United States Patent [19]

Dolan

[11] Patent Number: 5,449,415

[45] **Date of Patent: * Sep. 12, 1995**

[54] COMPOSITION AND PROCESS FOR TREATING METALS

[75] Inventor: Shawn E. Dolan, Sterling Heights, Mich.

[73] Assignee: Henkel Corporation, Plymouth Meeting, Pa.

[ * ] Notice: The portion of the term of this patent subsequent to Jun. 27, 2012 has been disclaimed.

[21] Appl. No.: 300,674

[22] Filed: Sep. 2, 1994

Related U.S. Application Data

[63] Continuation-in-part of Ser. No. 100,533, Jul. 30, 1993.

[51] Int. Cl.[6] ..... C23C 22/06; C23C 22/08

[52] U.S. Cl. ..... 148/259; 148/247; 148/248; 148/251; 148/254; 148/260; 106/14.12; 106/14.44; 427/327; 427/384

[58] Field of Search ..... 106/14.05, 14.12, 14.44; 148/259, 247, 248, 251, 254, 260; 427/385.5, 388.1, 388.4, 407.1, 409, 410, 327, 384

[56] References Cited

U.S. PATENT DOCUMENTS

| | | | |
|---|---|---|---|
| 4,039,353 | 8/1977 | Kulick et al. | 148/257 |
| 4,132,572 | 1/1979 | Parant et al. | 106/14.12 |
| 4,337,097 | 6/1982 | Tokumasu et al. | 148/259 |
| 4,433,015 | 2/1984 | Lindert | 427/388.4 |
| 4,565,585 | 1/1986 | Matsuda | 148/241 |
| 4,680,064 | 7/1987 | Portz et al. | 148/617 |
| 4,828,615 | 5/1989 | Cape | 106/141 |
| 4,916,176 | 4/1990 | Vachlas et al. | 524/140 |
| 4,921,552 | 5/1990 | Sander et al. | 14.8/247 |
| 4,944,812 | 7/1990 | Lindert et al. | 148/251 |
| 4,963,596 | 10/1990 | Lindert et al. | 526/313 |
| 5,064,468 | 11/1991 | Okai et al. | 106/14.12 |
| 5,073,196 | 12/1991 | Fotinos et al. | 106/287.19 |

FOREIGN PATENT DOCUMENTS

| | | | |
|---|---|---|---|
| 1206851 | 7/1986 | Canada | 106/14.12 |
| 0358338 | 3/1990 | European Pat. Off. . | |

*Primary Examiner*—Anthony Green

*Attorney, Agent, or Firm*—Ernest G. Szoke; Wayne C. Jaeschke; Norvell E. Wisdom, Jr.

[57] ABSTRACT

A chromium free conversion coating at least equivalent in corrosion protective quality to conventional chromate conversion coatings can be formed on metals, particularly cold rolled steel, by a dry-in-place aqueous acidic liquid comprising:

(A) a component of anions, each of said anions consisting of (i) at least four fluorine atoms and (ii) at least one atom of an element selected from the group consisting of titanium, zirconium, hafnium, silicon, and boron, and, optionally, (iii) ionizable hydrogen atoms, and, optionally, (iv) one or more oxygen atoms;

(B) a component of cations of elements selected from the group consisting of cobalt, magnesium, manganese, zinc, nickel, tin, zirconium, iron, and copper; the ratio of the total number of cations of this component to the total number of anions of component (A) being at least 1:5;

(C) sufficient free acid to give the composition a pH in the range from 0.5 to 5.0;

(D) a component selected from the group consisting of phosphorus-containing inorganic oxyanions and phosphonate anions; and (E) a component selected from the group consisting of water-soluble and water-dispersible organic polymers and polymer-forming resins and, preferably, also including a component selected from the group consisting of tungstate, molybdate, silicotungstate, and silicomolybdate anions.

20 Claims, No Drawings

COMPOSITION AND PROCESS FOR TREATING METALS

CROSS-REFERENCE TO RELATED APPLICATION

This application is a continuation-in-part of copending application Ser. No. 08/100,533 filed Jul. 30, 1993.

BACKGROUND OF THE INVENTION

1. Field of the Invention

This invention relates to compositions and processes for treating metal surfaces with acidic aqueous compositions for forming conversion coatings on the metals; the conversion coatings provide excellent bases for subsequent painting. The invention is well suited to treating iron and steel, galvanized iron and steel, zinc and those of its alloys that contain at least 50 atomic percent zinc, and aluminum and its alloys that contain at least 50 atomic percent aluminum. Preferably the surface treated is predominantly ferrous; most preferably the surface treated is cold rolled steel.

2. Statement of Related Art

A very wide variety of materials have been taught in the prior art for the general purposes of the present invention, but most of them contain hexavalent chromium which is environmentally undesirable. One object of this invention is to avoid any substantial use of hexavalent chromium and other materials such as ferricyanide that have been identified as environmentally damaging.

DESCRIPTION OF THE INVENTION

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, unless expressly stated to the contrary: percent, "parts of", and ratio values are by weight; the term "polymer" includes oligomer; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; specification of materials in ionic form implies the presence of sufficient counterions to produce electrical neutrality for the composition as a whole (any counterions thus implicitly specified should preferably be selected from among other constituents explicitly specified in ionic form, to the extent possible; otherwise such counterions may be freely selected, except for avoiding counterions that act adversely to the objects of the invention); and the term "mole" and its variations may be applied to elemental, ionic, and any other chemical species defined by number and type of atoms present, as well as to compounds with well defined molecules.

SUMMARY OF THE INVENTION

It has been found that excellent resistance to corrosion, particularly after subsequent conventional coating with an organic binder containing protective coating such as a paint or lacquer, can be imparted to active metal surfaces, particularly to iron and steel and other ferrous surfaces, by contacting the metal surfaces for a sufficient time at a sufficient temperature with a composition as described in detail below. Preferably, the composition is coated in a substantially uniform layer over the metal surface to be treated and then dried in place on the surface of the metal, without intermediate rinsing.

A composition according to the invention comprises, preferably consists essentially of, or more preferably consists of, water and:

(A) a component of fluorometallate anions, each of said anions consisting of (i) at least four fluorine atoms, (ii) at least one atom of an element selected from the group consisting of titanium, zirconium, hafnium, silicon, aluminum, and boron, and, optionally, one or both of (iii) ionizable hydrogen atoms, and (iv) one or more oxygen atoms; preferably the anions are fluotitanate (i.e., $TiF_6^{-2}$) or fluozirconate (i.e., $ZrF_6^{-2}$), most preferably fluotitanate;

(B) a component of divalent or tetravalent cations of elements selected from the group consisting of cobalt, magnesium, manganese, zinc, nickel, tin, copper, zirconium, iron, and strontium; preferably at least 60% by weight of the total of component (B) consisting of cobalt, nickel, manganese, or magnesium, more preferably of manganese, cobalt, or nickel; preferably, with increasing preference in the order given, the ratio of the total number of cations of this component to the number of anions in component (A) is at least 1:5, 1:3, 2:5, 3:5, 7:10, or 4:5; independently, with increasing preference in the order given, the ratio of the number of cations of this component to the number of anions in component (A) is not greater than 3:1, 5:2, 5:3, 10:7, 5:4, or 1.1:1;

(C) a component of phosphorus-containing inorganic oxyanions and/or phosphonate anions; and (D) a component of water-soluble and/or -dispersible organic polymers and/or polymer-forming resins, preferably in an amount such that the ratio of the solids content of the organic polymers and polymer-forming resins in the composition to the solids content of component (A) is within the range from, with increasing preference in the order given, 1:5 to 3:1, 1:2 to 3:1, 0.75:1.0 to 1.9:1.0, 0.90:1.0 to 1.60:1.0, 1.07:1.0 to 1.47:1.0, or 1.17:1.0 to 1.37:1.0; and (E) free acid, preferably in an amount such that a working composition a pH value that is, with increasing preference in the order given, not less than 0.5, 1.0, 1.3, 1.7, 1.8, 1.9, or 2.0 and independently is, with increasing preference in the order given, not more than 6.7, 6.0, 5,5, 5.0, 4.5, 4.0, 3.8, 3.7, 3.6, or 3.5; and, optionally, one or more of:

(F) a dissolved oxidizing agent, preferably a peroxy compound, more preferably hydrogen peroxide;

(G) a component selected from the group consisting of tungstate, molybdate, silicotungstate, and silicomolybdate anions, with the latter two preferred; preferably, the amount of component (G) is such that the ratio of the total moles of tungsten and molybdenum in component (G) to the total moles of titanium, zirconium, hafnium, silicon, aluminum, and boron in component (A) is, with increasing preference in the order given, not less than 0.001, 0.005, 0.01, 0.03, 0.05, 0.06, 0.07, 0.08, 0.09, 0.10, 0.11, 0.12, 0.13, 0.14, 0.15, 0.160, 0.163, 0.166, 0.169, 0.172, or 0.175 and independently preferably is, with increasing preference in the order given, not more than 2, 1, 0.7, 0.5, 0.4, 0.35, 0.31, 0.29, 0.28, 0.27, or 0.26; and (H) a component selected from dissolved or dispersed complexes stabilized against settling, said complexes resulting from reaction between material that before reaction could be part of component (A) and one or more materials selected from the group consisting of metallic and metalloid elements and the oxides, hydroxides, and carbonates of these metallic or metalloid elements to produce a reaction product that is not part of any of components (A) through (G) as recited above; preferably this component results from reaction with silica or vanadium(V) oxide.

It should be understood that the components listed need not necessarily all be provided by separate chemicals. For example, it is preferred that the fluorometallate anions and phosphorous containing anions both be added in the form of the corresponding acids, thereby also providing some, and usually all, of the required free acid for component (E). Also, if the acidity, or any other source of oxidizing potential, of the composition is sufficiently high and the substrate that is contacted with it is predominantly ferrous, component (B) can be provided by iron dissolved from the substrate and need not be present in the liquid composition when the liquid composition is first contacted with the substrate.

Various embodiments of the invention include working compositions for direct use in treating metals, concentrates from which such working compositions can be prepared by dilution with water, processes for treating metals with a composition according to the invention, and extended processes including additional steps that are conventional per se, such as precleaning, rinsing, and, particularly advantageously, painting or some similar overcoating process that puts into place an organic binder containing protective coating over the conversion coating formed according to a narrower embodiment of the invention. Articles of manufacture including surfaces treated according to a process of the invention are also within the scope of the invention.

DESCRIPTION OF PREFERRED EMBODIMENTS

For a variety of reasons, it is preferred that compositions according to the invention as defined above should be substantially free from many ingredients used in compositions for similar purposes in the prior art. Specifically, it is increasingly preferred in the order given, independently for each preferably minimized component listed below, that these compositions, when directly contacted with metal in a process according to this invention, contain no more than 1.0, 0.35, 0.10, 0.08, 0.04, 0.02, 0.01, 0,001, or 0.0002, percent of each of the following constituents: hexavalent chromium; ferricyanide; ferrocyanide; sulfates and sulfuric acid; alkali metal and ammonium cations; pyrazole compounds; sugars; gluconic acid and its salts; glycerine; α-glucoheptanoic acid and its salts; and myoinositol phosphate esters and salts thereof.

Furthermore, in a process according to the invention that includes other steps than the drying into place on the surface of the metal of a layer of a composition as described above, it is preferred that none of these other steps include contacting the surfaces with any composition that contains more than, with increasing preference in the order given, 1.0, 0.35, 0.10, 0.08, 0.04, 0.02, 0.01, 0,003, 0.001, or 0.0002% of hexavalent chromium, except that a final protective coating system including an organic binder, more particularly those including a primer coat, may include hexavalent chromium as a constituent. Any such hexavalent chromium in the protective coating is generally adequately confined by the organic binder, so as to avoid adverse environmental impact.

In one embodiment of the invention, it is preferred that the acidic aqueous composition as noted above be applied to the metal surface and dried thereon within a short time interval. With increasing preference in the order given, the time interval during which the liquid coating is applied to the metal being treated and dried in place thereon, when heat is used to accelerate the process, is not more than 25, 15, 9, 7, 4, 3, 1.8, 1.0, or 0.7 second (hereinafter often abbreviated "sec"). In order to facilitate this rapid completion of a process according to this invention, it is often preferred to apply the acid aqueous composition used in the invention to a warm metal surface, such as one rinsed with hot water after initial cleaning and very shortly before treating with the aqueous composition according to this invention, and/or to use infrared or microwave radiant heating and/or convection heating in order to effect very fast drying of the applied coating. In such an operation, a peak metal temperature in the range from 30°–200° C., or more preferably from 40°–70° C., would normally be preferred.

In an alternative embodiment, which is equally effective technically and is satisfactory when ample time is available at acceptable economic cost, a composition according to this invention may be applied to the metal substrate and allowed to dry at a temperature not exceeding 40° C. In such a case, there is no particular advantage to fast drying.

The effectiveness of a treatment according to the invention appears to depend predominantly on the total amounts of the active ingredients that are dried in place on each unit area of the treated surface, and on the nature and ratios of the active ingredients to one another, rather than on the concentration of the acidic aqueous composition used. Thus, if the surface to be coated is a continuous fiat sheet or coil and precisely controllable coating techniques such as roll coaters are used, a relatively small volume per unit area of a concentrated composition may effectively be used for direct application. On the other hand, with some coating equipment, it is equally effective to use a more dilute acidic aqueous composition to apply a heavier liquid coating that contains about the same amount of active ingredients. As a general guide, it is normally preferable, with increasing preference in the order given, if the working composition has a concentration of at least 0.010, 0.020, 0.026, or 0.032 gram moles per kilogram of total composition (hereinafter "M/kg"), of component (A), at least 0.015, 0.030, 0.038, or 0.045 in gram-moles of phosphorus per kilogram (hereinafter often abbreviated as "$M_p$/kg") of component (C), and at least 0.10, 0.20, 0.26, or 0.35, % of solids from component (D). Working compositions containing up to from five to ten times these amounts of active ingredients are also generally fully practical to use, particularly when coating control is precise enough to meter relatively thin uniform films of working composition onto the metal surface to be treated according to the invention.

Preferably the amount of composition applied in a process according to this invention is chosen so as to result in a total add-on mass (after drying) that is, with increasing preference in the order given, not less than from 5, 10, 25, 50, 60, 70, 80, or 90 milligrams per square meter (hereinafter "$mg/m^2$") of surface treated, and independently is, with increasing preference in the order given, not more than 500, 400, 300, 275,250, 225, or 200 $mg/m^2$,. The add-on mass of the protective film formed by a process according to the invention may be conveniently monitored and controlled by measuring the add-on weight or mass of the metal atoms in the anions of component (A) as defined above. The amount of these metal atoms may be measured by any of several conventional analytical techniques known to those skilled in the art. The most reliable measurements generally involve dissolving the coating from a known area of coated substrate and determining the content of the metal of interest in the resulting solution. The total add-on mass can then be calculated from the known relationship between the amount of the metal in component (A) and the total mass of the part of the total composition that remains after drying. For the purpose of this calculation it is assumed that all water in the working composition, including any water of hydration in any solid constituent added to the composition during its preparation, is expelled by drying but that all other constituents of the liquid film of working composition coated onto the surface measured remain in the dried coating.

In a concentrated acidic aqueous composition to be used according to the invention, either directly as a working composition or as a source of active ingredients for making up a more dilute working composition, the concentration of component (A) as described above is preferably from 0.15 to 1.0 M/kg, or more preferably from 0.30 to 0.75 M/kg.

Component (C) as defined above is to be understood as including all of the following inorganic acids and their salts that may be present in the composition: hypophosphorous acid ($H_3PO_2$), orthophosphorous acid ($H_3PO_3$), pyrophosphoric acid ($H_4P_2O_7$), orthophosphoric acid ($H_3PO_4$), tripolyphosphoric acid ($H_5P_3O_{10}$), and further condensed phosphoric acids having the formula $H_{x+2}P_xO_{3x+1}$, where x is a positive integer greater than 3. Component (C) also includes all phosphonic acids and their salts. In a concentrated composition, the concentration of component (C) of the total composition, is preferably from 0.15 to 1.0 $M_p$/kg, or more preferably from 0.30 to 0.75 $M_p$/kg.

Generally, inorganic phosphates, particularly orthophosphates, phosphites, hypophosphites, and/or pyrophosphates, especially orthophosphates, are preferred for component (C) because they are more economical. Phosphonates are also suitable and may be advantageous for use with very hard water, because the phosphonates are more effective chelating agents for calcium ions. Acids and their salts in which phosphorus has a valence less than five may be less stable than the others to oxidizing agents and are less preferred in compositions according to the invention that are to contain oxidizing agents.

Component (D) is preferably selected from the group consisting of epoxy resins, aminoplast (i.e., melamine-formaldehyde and urea-formaldehyde) resins, tannins, phenol-formaldehyde resins, and polymers of vinyl phenol with sufficient amounts of alkyl- and substituted alkyl-aminomethyl substituents on the phenolic rings to render the polymer water soluble or dispersible. More preferably, component (D) is selected from epoxy resins and/or, most preferably only from, polymers and/or copolymers of one or more y-(N-$R^1$-N-$R^2$-aminomethyl)-4-hydroxy-styrenes, where y=2, 3, 5, or 6, $R^1$ represents an alkyl group containing from 1 to 4 carbon atoms, preferably a methyl group, and $R^2$ represents a substituent group conforming to the general formula $H(CHOH)_nCH_2$—, where n is an integer from 1 to 7, preferably from 3 to 5. The average molecular weight of these polymers preferably is within the range from 700 to 70,000, or more preferably from 3,000 to 20,000. The concentration of component (D) in a concentrated composition is preferably from 1.0 to 10%, or more preferably from 4.5–7.5%.

If used, component (F) preferably is present in a working composition according to this invention in a an amount to provide a concentration of oxidizing equivalents per liter of composition that is equal to that of a composition containing from 0.5 to 15, or more preferably from 1.0 to 9.0% of hydrogen peroxide. (The term "oxidizing equivalent" as used herein is to be understood as equal to the number of grams of oxidizing agent divided by the equivalent weight in grams of the oxidizing agent. The equivalent weight of the oxidizing agent is the gram molecular weight of the agent divided by the change in valency of all atoms in the molecule which change valence when the molecule acts as an oxidizing agent; usually, this is only one element, such as oxygen in hydrogen peroxide.)

The presence of component (G) as described above is generally preferred, because the corrosion resistance of subsequently painted surfaces treated with such compositions is generally improved over that achieved on surfaces treated with other similar compositions lacking component (G).

The term "stabilized against settling" in the description of component (H) above means that the composition containing the material does not suffer any visually detectable settling or separation into distinct liquid phases when stored for a period of 100, or more preferably 1000, hours at 25° C. Materials for component (H) may be prepared by adding one or more metallic and/or metalloid elements or their oxides, hydroxides, and/or carbonates to an aqueous composition containing all or part of component (A). A spontaneous chemical reaction normally ensues, converting the added element, oxide, hydroxide, or carbonate into a soluble species. The reaction to form this soluble species can be accelerated by use of heat and stirring or other agitation of the composition. The formation of the soluble species is also aided by the presence in the composition of suitable complexing ligands, such as peroxide and fluoride. Preferably the amount of component (H) when used in a concentrate composition is not greater than that formed by addition, with increasing preference in the order given, of up to 50, 20, 12, 8, 5, or 4 parts per thousand, based on the ultimate total mass of the concentrate composition, of the metallic or metalloid element or its stoichiometric equivalent in an oxide, hydroxide, or carbonate, to the concentrate composition. Independently, the amount of component (H) when used in a concentrate composition preferably is at least as great as that formed by addition, with increasing preference in the order given, of at least 0.1, 0.20, 0.50, or 1.0 parts per thousand, based on the ultimate total mass of the concentrate composition, of the metallic or metalloid element or its stoichiometric equivalent in an oxide, hydroxide, or carbonate, to the concentrate composition.

A working composition according to the invention may be applied to a metal workpiece and dried thereon by any convenient method, several of which will be readily apparent to those skilled in the art. For example, coating the metal with a liquid film may be accomplished by immersing the surface in a container of the liquid composition, spraying the composition on the surface, coating the surface by passing it between upper and lower rollers with the lower roller immersed in a container of the liquid composition, and the like, or by a mixture of methods. Excessive amounts of the liquid composition that might otherwise remain on the surface prior to drying may be removed before drying by any convenient method, such as drainage under the influence of gravity, squeegees, passing between rolls, and the like. Drying also may be accomplished by any convenient method, such as a hot air oven, exposure to infrared radiation, microwave heating, and the like.

For flat and particularly continuous flat workpieces such as sheet and coil stock, application by a roller set in any of several conventional arrangements, followed by drying in a separate stage, is generally preferred. The temperature during application of the liquid composition may be any temperature within the liquid range of the composition, although for convenience and economy in application by roller coating, normal room temperature, i.e., from 20°–30° C., is usually preferred. In most cases for continuous processing of coils, rapid operation is favored, and in such cases drying by infrared radiative heating, to produce a peak metal temperature in the range already given above, is generally preferred.

Alternatively, particularly if the shape of the substrate is not suitable for roll coating, a composition may be sprayed onto the surface of the substrate and allowed to dry in place. Such cycles can be repeated as often as needed until the desired thickness of coating, generally measured in $mg/m^2$, is achieved. For this type of operation, it is preferred that the temperature of the metal substrate surface during application of the working composition be in the range from 20 to 300, more preferably from 30 to 100, or still more preferably from 30° to 90° C.

Preferably, the metal surface to be treated according to the invention is first cleaned of any contaminants, particularly organic contaminants and foreign metal fines and/or inclusions. Such cleaning may be accomplished by methods known to those skilled in the art and adapted to the particular type of metal substrate to be treated. For example, for galvanized steel surfaces, the substrate is most preferably cleaned with a conventional hot alkaline cleaner, then rinsed with hot water, squeegeed, and dried. For aluminum, the surface to be treated most preferably is first contacted with a conventional hot alkaline cleaner, then rinsed in hot water, then, optionally, contacted with a neutralizing acid rinse, before being contacted with an acidic aqueous composition as described above.

The invention is particularly well adapted to treating surfaces that are to be subsequently further protected by applying conventional organic protective coatings such as paint, lacquer, and the like over the surface produced by treatment according to the invention.

The practice of this invention may be further appreciated by consideration of the following, non-limiting, working examples, and the benefits of the invention may be further appreciated by reference to the comparison examples.

Preparation and Composition of Concentrates

The compositions of concentrates are given in Tables 1 and 2. The polymer of substituted vinyl phenol used as component (D) in most of the examples was made according to the directions of column 11 lines 39–52 of U.S. Pat. No. 4,963,596. The solution contained 30% of the solid polymer, with the balance water. This solution is identified as "Aminomethyl substituted polyvinyl phenol". RIX 95928 epoxy resin dispersion from Rhône-Poulenc, which was used alternatively as component (D) in these examples, is described by its supplier as a dispersion of polymers of predominantly diglycidyl ethers of bisphenol-A, in which some of the epoxide groups have been converted to hydroxy groups and the polymer molecules are phosphate capped. The concentrates were prepared generally by adding the acidic ingredients to most of the water required, then dissolving the metallic and/or metallic salt or oxide ingredients with manganese(II) oxide being added last among these ingredients if used, then the organic film forming agents, then silica if used, and finally hydrogen peroxide if used.

The metallic tin and iron noted as part of some compositions in Tables 1 and 2 react with the acid constituents to yield cations that are part of component (B), while the vanadium oxide and silica noted as added in the table are all believed to react with part of the fluotitanic acid and/or hydrogen peroxide to constitute component (H) as defined above. For example, when vanadium oxide and hydrogen peroxide are added to Concentrate Composition 9 as shown in Table 1, at a point when the partial composition already contains fluotitanic and phosphoric acids but not manganese(II) oxide, the mixture dissolves and forms a solution that is reddish-brown

TABLE 1

| Ingredient | Concentration in Parts of Ingredient in Composition Number: | | | | | | | | | | | | |
|---|---|---|---|---|---|---|---|---|---|---|---|---|---|
| | 1 | 2 | 3 | 4 | 5 | 6 | 7 | 8 | 9 | 10 | 11 | 12 | 13 |
| Deionized water | 649 | 646 | 641 | 636 | 646 | 647 | 640 | 638 | 634 | 649 | 646 | 641 | 336 |
| 60% $H_2TiF_6$ in water | 81 | 80 | 81 | 80 | 80 | 80 | 80 | 82 | 82 | 81 | 80 | 81 | 84 |
| 75% $H_3PO_4$ in water | 46 | 46 | 47 | 46 | 46 | 46 | 46 | 47 | 46 | 46 | 46 | 47 | 46 |
| "Aminomethyl substituted polyvinyl phenol" | 204 | 204 | 206 | 204 | 204 | 204 | 204 | 208 | 204 | 204 | 204 | 206 | 205 |
| Nickel Carbonate ($NiCO_3$) | | | | | | | | | | | | | 36 |
| Magnesium carbonate ($MgCO_3$) | 20 | | | | | | | | | 20 | | 21 | |
| Manganese(II) oxide (MnO) | | 24 | 21 | | 20 | 20 | 20 | 24.4 | 24 | | 24 | 4 | |
| Zinc carbonate ($ZnCO_3$) | | | 4 | | | | | | | | | | |
| Cobalt(II) carbonate ($CoCO_3$) | | | | 34 | 4 | | | | | | | | |
| Zirconium Basic Carbonate stoichiometrically equivalent to 40% $ZrO_2$ | | | | | | | 10 | | | | | | |

TABLE 1-continued

| Ingredient | Concentration in Parts of Ingredient in Composition Number: 1 | 2 | 3 | 4 | 5 | 6 | 7 | 8 | 9 | 10 | 11 | 12 | 13 |
|---|---|---|---|---|---|---|---|---|---|---|---|---|---|
| Metallic tin powder | | | | | | 3 | | | | | | | |
| Metallic iron powder | | | | | | | | 0.6 | | | | | |
| Vanadium(V) oxide ($V_2O_5$) | | | | | | | | | 2 | | | | |
| 30% $H_2O_2$ in water | | | | | | | | | 8 | | | | 293 |

TABLE 2

| Ingredient | Concentration in Parts of Ingredient in Composition Number: 14 | 15 | 16 | 17 | 18 | 19 | 20 | 21 | 22 | 23 |
|---|---|---|---|---|---|---|---|---|---|---|
| Deionized water | 636 | 646 | 647 | 692 | 701 | 697 | 666 | 457 | 622 | 623 |
| 60% $H_2TiF_6$ in water | 80 | 80 | 80 | 84 | 50 | 80 | 84 | | 82 | 82 |
| 75% $H_3PO_4$ in water | 46 | 46 | 46 | | 45 | 46 | | 45 | 47 | 47 |
| "Aminomethyl substituted polyvinyl phenol" | 204 | 204 | 204 | 204 | 204 | | | 204 | 208 | 208 |
| RIX 95928 epoxy resin dispersion from Rhone-Poulene (40% solids) | | | | | | 153 | 230 | | | |
| Silicotungstic acid ($H_8SiW_{12}O_{43}$) | | | | | | | | | 13 | |
| Silicomolybdic acid ($H_8SiMo_{12}O_{42}$) | | | | | | | | | | 12 |
| Manganese(II) oxide (MnO) | | 20 | 20 | | | 24 | | | 28 | 28 |
| Zinc carbonate (ZnCO,) | | | | | | | | | | |
| Cobalt(II) carbonate ($CoCO_3$) | 34 | 4 | | | | | | | | |
| Metallic tin powder | | | 3 | | | | | | | |
| Zirconium Basic Carbonate stoichiometrically equivalent to 40% $ZrO_2$ | | | | 15 | | | 15 | | | |
| Silica ($SiO_2$) - Cab-O-Sil TM M-5 | | | | 5 | | | 5 | | | |
| 30% $H_2O_2$ in water | | | | | | | | 294 | | |

in color, the known color of some vanadium complexes containing a peroxygen ligand. After the manganese(II) oxide is added, there is a vigorous evolution of a gas believed to be oxygen, and the solution becomes green. Addition of even small quantities of hydrogen peroxide to such a solution regenerates a red-brown color.

Preparation of Working Compositions from the Concentrates

Preparation was generally by diluting the concentrates with deionized water and, in some cases, adding additional ingredients. Details are given in Table 3. Composition 18 is not according to the invention when prepared, because it lacks component (B). However, when this composition is applied to cold rolled steel, reactive dissolution of the steel is so vigorous that enough iron is dissolved into the working composition to cause it to function according to the invention.

General Process Conditions and Test Methods

Test pieces of cold rolled steel were spray cleaned for 15 seconds at 60° C. with an aqueous cleaner containing 22 g/L of PARCO® CLEANER 338 (commercially available from the Parker Amchem Division of Henkel Corp., Madison Heights, Mich., USA). After cleaning, the panels were rinsed with hot water, squeegeed, and dried before roll coating with an acidic aqueous composition as described for the individual examples and comparison examples below. This applied liquid was flash dried in an infrared oven that produces approximately 50° C. peak metal temperature.

The mass per unit area of the coating was determined on some samples at this point in the process by dissolving the coating in aqueous hydrochloric acid and determining the titanium content in the resulting solution by inductively coupled plasma spectroscopy, which measures the quantity of a specified element.

After drying, the panels were normally coated with a conventional paint or paint system according to the manufacturer's directions. The following paint systems, and identifiers for them in the subsequent tables, were used:

High Reflectance White Polyester Paint 408-1-W-249 from Specialty Coatings Company, Inc.—Designated "A".

60 G Metalux Black Polyester Paint 408-1-K-247 from Specialty Coatings Company, Inc.—Designated "B".

80G Newell White hint 408-1-W-976 from Specialty Coatings Company, Inc.—Designated "C".

TABLE 3

| Working Composition for Example or Comparison Example Number: | Parts in Working Composition of: Deionized Water | Concentrate | 30% $H_2O_2$ in Water | 75% $H_3PO_4$ in Water | 1-Hydroxyethylene-1,1-diphosphonic acid | 48% HF in Water |
|---|---|---|---|---|---|---|
| 1 | 166 | 34 | | | | |
| 2 | 166 | 34 | | | | |
| 3 | 166 | 34 | | | | |
| 4 | 172 | 28 | | | | |
| 5 | 172 | 28 | | | | |
| 6 | 172 | 28 | | | | |
| 7 | 172 | 28 | | | | |
| 8 | 172 | 28 | | | | |
| 9 | 172 | 28 | | | | |
| 10 | 166 | 34 | 10 | | | |
| 11 | 166 | 34 | 10 | | | |
| 12 | 166 | 34 | 10 | | | |
| 13 | 166 | 34 | | | | |
| 14 | 166 | 34 | 10 | | | |
| 15 | 166 | 34 | 10 | | | |
| 16 | 166 | 34 | 10 | | | |
| 17a | 171 | 29 | 8.5 | 0.77 | | |
| 17b | 171 | 29 | 8.5 | | 0.85 | |
| 18 | 171 | 30 | 8.8 | | | |
| 19 | 172 | 28 | 10 | | | |
| 20 | 170 | 30 | 10 | 1.0 | | |
| 21a | 166 | 34 | | | | |
| 21b | 166 | 34 | | | | 0.5 |
| 21c | 166 | 34 | | | | 1.0 |
| 22 | 182 | 18 | | | | |

TABLE 3-continued

| Working Composition for Example or Comparison Example Number: | Parts in Working Composition of: Deionized Water | Concentrate | 30% $H_2O_2$ in Water | 75% $H_3PO_4$ in Water | 1-Hydroxyethylene-1,1-diphosphonic acid | 48% HF in Water |
|---|---|---|---|---|---|---|
| 23 | 176 | 24 | | | | |

Notes for Table 3
The concentrate used for each working composition had the same number as the numeric part of the number of the working composition. Blanks indicate that none of the noted ingredient was added to the working composition in question, and there were no other ingredients added to the working composition at the time of its contact with the substrate to be treated. Compositions 21a–21c are comparison examples.

T-Bend tests were according to American Society for Testing Materials (hereinafter "ASTM") Method D4145-83; Impact tests were according to ASTM Method D2794-84E1 with 140 inch-pounds of impact force; and Salt Spray tests were according to ASTM Method B-117-90 Standard for 168 hours, with scribe creepage values reported.

Control (A type of Comparative Example)

The composition used here was made from BONDERITE TM 1402W, a chromium containing dry-in-place treatment that is commercially available from Parker Amthem Div. of Henkel Corp., Madison Heights, Mich., USA. The material was prepared and used as directed by the manufacturer, under the same conditions as those of the other comparative examples.

Results of the "Control", the working examples, and the other comparison examples are shown in Table 4. Most examples according to the invention produced test results as good or better than the "Control" with hexavalent chromium in every respect.

TABLE 4

| Working Composition Number | Coating Add-On Mass, mg/M$^2$ | Test Results with: Paint System A 0 T-Bed | Impact | Salt Spray | Paint System B 1 T-Bend | Impact | Salt Spray | Paint System C 0 T-Bend | Impact | Salt Spray |
|---|---|---|---|---|---|---|---|---|---|---|
| 1 | 140 | 9.8 | 10 | 1–2 | 10 | 10 | 2–4 | 10 | 10 | 1–2 |
| 2 | 140 | 9.9 | 10 | 1–2 | | | | | | |
| 3 | 140 | 9.9 | 10 | 1–3 | | | | | | |
| 4 | 200 | 9.8 | 10 | 1–2 | 10 | 10 | 2–4 | 9.9 | 10 | 0–1$^{2s}$ |
| 5 | 180 | 9.9 | 10 | 0–1 | 9.9 | 10 | 2–2 | 9.9 | 10 | 0–1 |
| 6 | 140 | 9.0 | 10 | 0–1 | 9.9 | 10 | 1–2 | 10 | 10 | 0–1 |
| 7 | 140 | 9.9 | to | 0–1 | 8.5 | 10 | 2–2 | 10 | 10 | 0–1 |
| 8 | 90 | 9.8 | 10 | 0–1 | 10 | 10 | 2–2 | 10 | 10 | 0–1 |
| 9 | 110 | 9.8 | 10 | 0–1 | 10 | 10 | 1–1$^{2s}$ | 10 | 10 | 0–1 |
| 10 | 140 | 9.4 | 10 | 0–1 | 10 | 10 | 2–4 | 10 | 10 | 0–1 |
| 11 | 140 | 9.9 | 10 | 0–1 | | | | 10 | 10 | 0–1 |
| 12 | 140 | 9.9 | 10 | 0–1 | | | | | | |
| 13 | 150 | 9.0 | 10 | 0–1 | 10 | 10 | 3–3 | 10 | 10 | 0–1$^{s}$ |
| 14 | 200 | 10 | 10 | 0–1 | 10 | 10 | 4–5 | 10 | 10 | 0–1$^{s}$ |
| 15 | 30 | 9.9 | 10 | 0–1 | 9.9 | 10 | 3–4 | 9.9 | 10 | 1–1 |
| 16 | 140 | 9.9 | 10 | 1–1 | 9.9 | 10 | 4–4 | 10 | 10 | 0–1$^{2s}$ |
| 17a | 150 | 9.8 | 10 | 1–1 | 10 | 10 | 4–5 | 10 | 10 | 1–1 |
| 17b | 150 | 9.8 | 10 | 1–1 | 10 | 10 | 8–8 | 10 | 10 | 1–1 |
| 18 | 150 | 9.6 | 10 | 1–1 | 10 | 10 | 4–4 | 10 | 10 | 0–2 |
| 19 | 180 | 9.7 | 10 | 3–3 | 10 | 10 | 5–5 | 10 | 10 | 3–3 |
| 20 | 300 | 9.7 | 10 | 0–1 | | | | | | |
| 21a | 140 | 10 | 10 | 6–12 | 10 | 10 | 12–16 | 10 | 10 | 9–12 |
| 21b | 140 | 10 | 10 | 14–14 | 10 | 10 | failure | 10 | 10 | failure |
| 21c | 140 | 9.5 | 10 | 16–16 | 10 | 10 | failure | 10 | 10 | failure |
| 22 | 130 | 9.9 | 10 | 0–1 | 9.5 | 10 | 2–2 | 9.8 | 10 | 0–1 |
| 23 | 200 | 9.0 | 10 | 0–1 | 9.0 | 10 | 2–2 | 9.9 | 10 | 1–1 |
| Control | 200 | 9.9 | 10 | 1–1$^{2s}$ | 10 | 10 | 2–3 | 10 | 10 | 0–1$^{2s}$ |
| Control | 300 | 10 | 10 | 1–2 | 10 | 10 | 2–4 | 10 | 10 | 1–2 |

Note for Table 4
Blanks indicate no test.

I claim:

1. An aqueous liquid composition for treating metal surfaces, either as such or after dilution with additional water, said composition consisting essentially of water and:

(A) at least about 0.15M/kg of a component of fluorometallate anions, each of said anions consisting of (i) at least four fluorine atoms, (ii) at least one atom of an element selected from the group consisting of titanium, zirconium, hafnium, silicon, aluminum, and boron, and, optionally, one or more of (iii) ionizable hydrogen atoms and (iv) oxygen atoms;

(B) a component of divalent or tetravalent cations of elements selected from the group consisting of cobalt, magnesium, manganese, zinc, nickel, tin, copper, zirconium, iron, and strontium in such an amount that the ratio of the total number of cations of this component to the number of anions in component (A) is at least about 1:5 but not greater than about 3:1;

(C) at least about 0.15$M_p$/kg of a component selected from the group consisting of phosphorus-containing inorganic oxyanions and phosphonate anions; and (D) at least about 1.0% of a component selected from the group consisting of water-soluble and water-dispersible organic polymers and polymer-forming resins, the amount of this component also being such that the ratio of the solids content of the organic polymers and polymer-forming resins in the composition to the solids content of component (A) is within the range from about 1:2 to 3:1; and (E) sufficient free acid to give the composition a pH value from about 0.5 to about 5.0.

2. A composition according to claim 1, which also includes a component (G) selected from the group consisting of tungstate, molybdate, silicotungstate, and silicomolybdate anions in an amount such that the ratio of the total moles of tungsten and molybdenum in the composition to the total moles of titanium, zirconium, hafnium, silicon, aluminum, and boron in component (A)is not less than about 0.03 and which optionally also includes one or both of a component (F) of dissolved oxidizing agent and a component (H) of dissolved or dispersed complexes stabilized against settling, said complexes resulting from reaction between (a) fluorometallate anions, each of said anions consisting of (i) at least four fluorine atoms, (ii) at least one atom of an element selected from the group consisting of titanium, zirconium, hafnium, silicon, aluminum, and boron, and, optionally, one or more of (iii) ionizable hydrogen atoms and (iv) oxygen atoms and (b) one or more materials selected from the group consisting of metallic and metalloid elements and the oxides, hydroxides, and carbonates of these metallic or metalloid elements to produce a reaction product other than one which is part of components (A) through (G).

3. A composition according to claim 2, wherein component (A) is selected from fluotitanate and fluozirconate anions; at least 60% of component (B) is selected from the group consisting of cobalt, nickel, manganese, and magnesium, and the ratio of the total number of cations of component (B) to the number of anions in component (A) is at least about 1:5 but not greater than about 5:2; component (C) is selected from orthophosphate, phosphite, hypophosphite, phosphonate and pyrophosphate anions; component (D) is selected from the group consisting of epoxy resins, aminoplast resins, tannins, phenol-formaldehyde resins, and polymers of vinyl phenol containing phenolic rings with sufficient amounts of alkyl- and substituted alkyl-aminomethyl substituents on the phenolic rings to render the polymers water soluble or dispersible to the extent of at least 1%; and the amount of component (D) is such that the ratio of the solids content of the organic polymers and polymer-forming resins in the composition to the solids content of component (A) is within the range from about 0.75:1.0 to 1.9:1.

4. A composition according to claim 3, wherein component (A) is made up of fluotitanate anions; at least 60% of component (B) is selected from the group consisting of cobalt, nickel, and manganese, and the ratio of the total number of cations of component (B) to the number of anions in component (A) is at least about 1:3 but not greater than about 10:7; the amount of component (C) is from about 0.30 to 0.75$M_p$/kg; component (D) is selected from the group consisting of epoxy resins and polymers and copolymers of one or more y-(N-$R^1$-N-$R^2$-aminomethyl)-4-hydroxystyrenes, where y=2, 3, 5, or 6, $R^1$ represents an alkyl group containing from 1 to 4 carbon atoms, and $R^2$ represents a substituent group conforming to the general formula $H(CHOH)_nCH_2$-, where n is an integer from 1 to 7, the polymers and copolymers of one or more y-(N-$R^1$-N-$R^2$-aminomethyl)-4-hydroxystyrenes having an average molecular weight within the range from about 700 to about 70,000; the concentration of component (D) is from about 4.5 to about 7.5%; and the amount of component (D) is such that the ratio of the solids content of the organic polymers and polymer-forming resins in the composition to the solids content of component (A) is within the range from about 0.90:1.0 to 1.6:1.

5. A process for treating a metal surface, said process comprising steps of:

(I) coating the metal surface with a substantially uniform coating of an aqueous acidic liquid composition consisting essentially of water and:

(A) a component of fluorometallate anions, each of said anions consisting of (i) at least four fluorine atoms, (ii) at least one atom of an element selected from the group consisting of titanium, zirconium, hafnium, silicon, aluminum, and boron, and, optionally, (iii) ionizable hydrogen atoms, and, optionally, (iv) one or more oxygen atoms;

(B) a component of divalent or tetravalent cations of elements selected from the group consisting of cobalt, magnesium, manganese, zinc, nickel, tin, copper, zirconium, iron, and strontium in such an amount that the ratio of the total number of cations of this component to the number of anions in component (A) is at least about 1:5 but not greater than about 3:1;

(C) a component selected from the group consisting of phosphorus-containing inorganic oxyanions and phosphonate anions; and (D) a component selected from the group consisting of water-soluble and water-dispersible organic polymers and polymer-forming resins; and (E) free acid to provide a pH value for the composition within the range of about 0.5 to about 5.0; and (II) drying into place on the surface of the metal the coating applied in step (I), without intermediate rinsing.

6. A process according to claim 5, wherein the aqueous acidic liquid composition with which the metal is coated in step (I) also includes a component (G) selected from the group consisting of tungstate, molybdate, silicotungstate, and silicomolybdate anions in an amount such that the ratio of the total moles of tungsten and molybdenum in the composition to the total moles of titanium, zirconium, hafnium, silicon, aluminum, and boron in component (A) is not less than about 0.03 and which optionally also includes one or both of a component (F) of dissolved oxidizing agent and a component (H) of dissolved or dispersed complexes stabilized against settling, said complexes resulting from reaction between materials that before reaction could be part of component (A) and one or more materials selected from the group consisting of metallic and metalloid elements and the oxides, hydroxides, and carbonates of these metallic or metalloid elements to produce a reaction product other than one which is part of components (A) through (G).

7. A process according to claim 6, wherein, in the liquid composition with which the metal is coated in step (I), the concentration of component (A) is at least about 0.010M/kg; the ratio of the total number of cations of component (B) to the number of anions in component (A) is at least about 1:5 but not greater than about 3:1; the concentration of component (C) is at least about 0.015$M_p$/kg; the concentration of component (D)is at least about 0.10%, and the amount of component (G) is such that the ratio of the total moles of tungsten and molybdenum in the composition to the total moles of titanium, zirconium, hafnium, silicon, aluminum, and boron in component (A) is from about 0.06 to about 0.7.

8. A process according to claim 7, wherein, in the liquid composition with which the metal is coated in step (I), component (A) is selected from fluotitanate and fluozirconate anions and the concentration of component (A) is at least about 0.020M/kg; at least 60% of component (B) is selected from the group consisting of cobalt, nickel, manganese, and magnesium, and the ratio of the total number of cations of component (B) to the number of anions in component (A) is at least about 1:3 but not greater than about 5:2; component (C) is selected from orthophosphate, phosphite, hypophosphite, phosphonate and pyrophosphate anions, and the concentration of component (C) is at least about $0.030M_p$/kg; component (D) is selected from the group consisting of epoxy resins, aminoplast resins, tannins, phenolformaldehyde resins, and polymers of vinyl phenol containing phenolic rings with sufficient amounts of alkyl- and substituted alkyl-aminomethyl substituents on the phenolic rings to render the polymers water soluble or dispersible to the extent of at least 1%; the amount of component (D) is such that the ratio of the solids content of the organic polymers and polymer-forming resins in the composition to the solids content of component (A) is within the range from about 1:2 to 3.0:1.0; the concentration of component (D) is at least about 0.20%, and the amount of component (G) is such that the ratio of the total moles of tungsten and molybdenum in the composition to the total moles of titanium, zirconium, hafnium, silicon, aluminum, and boron in component (A) is from about 0.09 to about 0.5.

9. A process according to claim 8, wherein, in the liquid composition with which the metal is coated in step (I), the concentration of component (A) is at least about 0.026M/kg; component (B) is selected from the group consisting of cobalt, nickel, and manganese and the ratio of the total number of cations of component (B) to the number of anions in component (A) is at least about 1:3 but not greater than about 10:7; the concentration of component (C) is at least about $0.0380M_p$/kg; component (D) is selected from the group consisting of epoxy resins and polymers and copolymers of one or more y-(N-$R^1$-N-$R^2$-aminomethyl)-4-hydroxy-styrenes, where y=2, 3, 5, or 6, $R^1$ represents an alkyl group containing from 1 to 4 carbon atoms, and $R^2$ represents a substituent group conforming to the general formula $H(CHOH)_nCH_2$—, where n is an integer from 1 to 7, the polymers and copolymers of one or more y-(N-$R^1$-N-$R^2$-aminomethyl)-4-hydroxy-styrenes having an average molecular weight within the range from about 700 to about 70,000, and the amount of component (D) is such that the ratio of the solids content of the organic polymers and polymer-forming resins in the composition to the solids content of component (A) is within the range from about 0.75:1.0 to 1.9:1.0; the concentration of component (D) is at least about 0.26%, and the amount of component (G) is such that the ratio of the total moles of tungsten and molybdenum in the composition to the total moles of titanium, zirconium, hafnium, silicon, aluminum, and boron in component (A) is from about 0.12 to about 0.35.

10. A process according to claim 9, wherein, in the liquid composition with which the metal is coated in step (I), the concentration of component (A) is at least about 0.032M/kg; the ratio of the total number of cations of component (B) to the number of anions in component (A) is at least about 2:5 but not greater than about 5:4; the concentration of component (C) is at least about $0.045M_p$/kg; component (D) is selected from the group consisting of polymers and copolymers of one or more y-(N-$R^1$-N-$R^2$-aminomethyl)-4-hydroxy-styrenes, where y =2, 3, 5, or 6, $R^1$ represents a group, and $R^2$ represents a substituent group conforming to the general formula $H(CHOH)_nCH_2$—, where n is an integer from 4 to 6, the polymers and copolymers of one or more y-(N-$R^1$-N-$R^2$-aminomethyl)-4-hydroxy-styrenes having an average molecular weight within the range from about 3,000 to about 20,000, and the amount of component (D) is such that the ratio of the solids content of the organic polymers and polymer-forming resins in the composition to the solids content of component (A) is within the range from about 0.90:1.0 to about 1.6:1.0; the concentration of component (D)is at least about 0.35%, and the amount of component (G) is such that the ratio of the total moles of tungsten and molybdenum in the composition to the total moles of titanium, zirconium, hafnium, silicon, aluminum, and boron in component (A) is from about 0.15 to about 0.31.

11. A process according to claim 10, wherein, in the liquid composition with which the metal is coated in step (I), the ratio of the total number of cations of component (B) to the number of anions in component (A) is at least about 2:5 but not greater than about 1.1:1.0; the amount of component (D) is such that the ratio of the solids content of the organic polymers and polymer-forming resins in the composition to the solids content of component (A) is within the range from about 1.07:1.0 to about 1.47:1.0; and the amount of component (G) is such that the ratio of the total moles of tungsten and molybdenum in the composition to the total moles of titanium, zirconium, hafnium, silicon, aluminum, and boron in component (A) is from about 0.160 to about 0.27.

12. A process according to claim 11, wherein the metal surface is cold rolled steel and the liquid composition in step (I) is applied in an amount so as to result in a total add-on mass at the end of step (II) of the process that is within the range from 50–300 mg/$m^2$.

13. A process according to claim 10, wherein the metal surface is cold rolled steel and the liquid composition in step (I) is applied in an amount so as to result in a total add-on mass at the end of step (II) of the process that is within the range from 50–300 mg/$m^2$.

14. A process according to claim 9, wherein the metal surface is cold rolled steel and the liquid composition in step (I) is applied in an amount so as to result in a total add-on mass at the end of step (II) of the process that is within the range from 50–300 mg/$m^2$.

15. A process according to claim 8, wherein the metal surface is cold rolled steel and the liquid composition in step (I) is applied in an amount so as to result in a total add-on mass at the end of step (II) of the process that is within the range from 10–400 mg/$m^2$.

16. A process according to claim 7, wherein the metal surface is cold rolled steel and the liquid composition in step (I) is applied in an amount so as to result in a total add-on mass at the end of step (II) of the process that is within the range from 10–400 mg/$m^2$.

17. A process according to claim 6, wherein the metal surface is cold rolled steel and the liquid composition in step (I) is applied in an amount so as to result in a total add-on mass at the end of step (II) of the process that is within the range from 5–500 mg/$m^2$.

18. A process according to claim 5, wherein the metal surface is cold rolled steel and the liquid composition in step (I) is applied in an amount so as to result in a total add-on mass at the end of step (II) of the process that is within the range from 5–500 mg/m$^2$.

19. A process according to claim 11, comprising additional steps of conventionally cleaning the metal to be treated before step (I) and coating the metal surface after step (II) with a conventional protective coating containing an organic binder.

20. A process according to claim 5, comprising additional steps of conventionally cleaning the metal to be treated before step (I) and coating the metal surface after step (II) with a conventional protective coating containing an organic binder.

* * * * *

UNITED STATES PATENT AND TRADEMARK OFFICE

CERTIFICATE OF CORRECTION

PATENT NO. : 5,449,415

DATED : Sep. 12, 1995

INVENTOR(S) : Shawn E. Dolan

It is certified that error appears in the above-indentified patent and that said Letters Patent is hereby corrected as shown below:

In col. 3, line 60, delete [0,001] and insert --0.001--.

In col. 4, line 6, delete [0,003] and insert --0.003--.

In col. 4, line 49, delete [fiat] and insert --flat--.

In col. 9, Table 2:

row 5, column 1, delete [Rhone-Poulene] and insert --Rhône-Poulenc--.

row 6, column 1, delete [$H_8SiW_{12}O_{43}$] and insert --$H_8SiW_{12}O_{42}$--.

row 9, column 1, delete [ZnCO,] and insert --$ZnCO_3$--.

In col. 10, line 37, delete [hint] and insert --Paint--.

In col. 11, line 62, delete [Amthem] and insert --Amchem--.

UNITED STATES PATENT AND TRADEMARK OFFICE

CERTIFICATE OF CORRECTION

PATENT NO. : 5,499,415

DATED : September 12, 1995

INVENTOR(S) : Shawn E. Dolan

It is certified that error appears in the above-indentified patent and that said Letters Patent is hereby corrected as shown below:

In col. 12, Table 4:

row 7, column 4, delete [to] and insert --10--.
row 7, column 5, after "0-1" insert superscript --2s--.
row 9, column 5, after "0-1" insert superscript --s--.
row 13, column 5, after "0-1" insert superscript --s--.
row 14, column 5, after "0-1" insert superscript --s--.
row 15, column 2, delete [30] and insert --180--.

Signed and Sealed this

Twenty-fourth Day of September, 1996

*Attest:*

Bruce Lehman

BRUCE LEHMAN

*Attesting Officer*

*Commissioner of Patents and Trademarks*